US011872431B1

(12) United States Patent
Liu

(10) Patent No.: US 11,872,431 B1
(45) Date of Patent: Jan. 16, 2024

(54) FOLDABLE EXERCISE BAR DEVICE

(71) Applicant: Yanshan Fitting Sport Equipment Manufacturing co., Ltd, Hebei (CN)

(72) Inventor: Qiangsong Liu, Hebei (CN)

( * ) Notice: Subject to any disclaimer, the term of this patent is extended or adjusted under 35 U.S.C. 154(b) by 0 days.

(21) Appl. No.: 18/155,860

(22) Filed: Jan. 18, 2023

(51) Int. Cl.
*A63B 1/00* (2006.01)

(52) U.S. Cl.
CPC ..... *A63B 1/00* (2013.01); *A63B 2210/50* (2013.01); *A63B 2225/093* (2013.01)

(58) Field of Classification Search
CPC .. A63B 1/00; A63B 2210/50; A63B 2225/093
See application file for complete search history.

(56) References Cited

U.S. PATENT DOCUMENTS 860,517 A * 7/1907 Berglund ..... A63B 3/00 482/41
3,117,760 A * 1/1964 Dresbach ..... A63B 1/00 248/188.91
3,190,649 A * 6/1965 Heisler ..... A47B 25/003 473/496
3,318,269 A * 5/1967 Kinn ..... A47B 25/003 108/115
5,906,552 A * 5/1999 Padilla ..... A63B 69/0097 473/421
6,743,152 B2 * 6/2004 Weiss ..... A63B 4/00 482/34
6,880,828 B2 * 4/2005 Liao ..... A63B 69/0097 273/395
7,717,837 B2 * 5/2010 Florczak ..... A63B 1/00 482/62
D667,904 S * 9/2012 DeFrancisci ..... A63B 21/0442 D21/691
9,675,829 B1 * 6/2017 Katz ..... A63B 17/02
9,950,206 B2 * 4/2018 Biddix, Jr. ..... A63B 17/04
10,010,735 B2 * 7/2018 Kwo ..... A63B 1/00
10,813,832 B2 * 10/2020 Qiu ..... A47F 5/103
D961,025 S * 8/2022 Chen ..... D21/691
(Continued)

OTHER PUBLICATIONS

"PreGymnastic Updated 6ft Foldable Gymnastics Kip Bar" by PreGymnastic. Amazon: https://www.amazon.com/PreGymnastic-Foldable-Gymnastics-Teenagers-Adjustable/dp/B0BV6PWVVW/ref=cm_cr_arp_d_product_top?ie=UTF8, earliest sale date based on review Nov. 20, 2019 (Year: 2019).*
(Continued)

*Primary Examiner* — Andrew S Lo

(57) ABSTRACT

A foldable exercise bar device is includes a bar, a first supporter, a second supporter and a base module. The base module includes a first base element connected to an end of the first supporter away from the bar, a second base element facing with the first base element and connected to an end of the second supporter away from the bar, two first bottom rods pivotablely connected to two opposite sides of the first base element, two second bottom rods pivotablely connected to two opposite sides of the second base element. The foldable exercise bar device can be change between a support state and a foldable state, and in the foldable state, the two first bottom rods and the two second bottom rods are rotated to be parallel to the second supporter, such that the foldable exercise bar device can occupy a small space to improve user experience.

15 Claims, 7 Drawing Sheets

(56) References Cited

U.S. PATENT DOCUMENTS

| | | | | |
|---|---|---|---|---|
| 2007/0010375 | A1* | 1/2007 | Corte | A63B 1/00 482/41 |
| 2013/0225372 | A1* | 8/2013 | Rochford | A63B 21/0442 482/129 |
| 2013/0345026 | A1* | 12/2013 | Eberflus | A63B 1/00 482/38 |
| 2014/0152063 | A1* | 6/2014 | Huang | A45F 3/24 211/204 |
| 2020/0215402 | A1* | 7/2020 | Zhou | A63B 63/004 |
| 2020/0324165 | A1* | 10/2020 | Sasano | A63B 23/1236 |

OTHER PUBLICATIONS

"Sumery Foldable&Movable Gymnastic Kip Bar" by Sumery. Amazon: https://a.co/d/hlvCwD0 , date first available Jul. 2, 2021, earliest sale date based on review Nov. 23, 2021 (Year: 2021).*

"Seliyoo Foldable Gymnastics kip bar with mat, Gymnastics Horizontal bar" by Seliyoo. Amazon: https://a.co/d/11GhXHW, date first available Dec. 11, 2021, earliest sale date based on review Jul. 9, 2022 (Year: 2021).*

* cited by examiner

FOLDABLE EXERCISE BAR DEVICE

TECHNICAL FIELD

The present disclosure relates to the technical field of exercise equipment, in particular, to a foldable exercise bar device.

BACKGROUND

Exercise bar devices are widely known pieces of exercise equipment most commonly used in connection with gymnastics. An existing exercise bar device not only has the problem of low stability, but also occupies a large space.

SUMMARY

In order to overcome the shortcomings in the existing exercise bar device, the present disclosure provides a foldable exercise bar device.

The present disclosure also adopts the following technical solution:

The present disclosure provides a foldable exercise bar device, the foldable exercise bar device provides a bar, a first supporter connected to an end of the bar, a second supporter parallel to the first supporter and connected to the other end of the bar, and a base module including a first base element connected to an end of the first supporter away from the bar, a second base element facing with the first base element and connected to an end of the second supporter away from the bar, two first bottom rods pivotablely connected to two opposite sides of the first base element, two second bottom rods pivotablely connected to two opposite sides of the second base element; wherein when the foldable exercise bar device is in a support state, the two first bottom rods are arranged along a first line via the first base element and perpendicular to the first supporter, the two second bottom rods are arranged along a second line via the second base element and perpendicular to the second supporter, when the foldable exercise bar device is changed to a foldable state from the support state, the two first bottom rods are rotated relative to the first base element so as to be parallel to the first supporter, the two second bottom rods are rotated relative to the second base element so as to be parallel to the second supporter.

Further, the base module further includes a first connection rod connected between the first base element and the second base element and two second connection rods connected between the two first bottom rods and two second bottom rods respectively.

Further, the second connection rod is connected to an end of the corresponding one first bottom rod away from the first base element and an end of the corresponding one second bottom rod away from the second base element.

Further, the first connection rod and the second connection rod are parallel to each other and perpendicular to the two first bottom rods and the two second bottom rods.

Further, the foldable exercise bar device further includes two first foldable supporters, each first foldable supporter includes a first part pivotablely connected to the first bottom rod, a second part pivotablely connected to the first supporter, and a first pivotable connection assembly pivotablely connected between the first part and the second part, when the foldable exercise bar device is in the support state, the first part and the second part are arranged along a line via the first pivotable connection assembly such that the first foldable supporter supports between the first supporter and the first bottom rod, when the foldable exercise bar device is changed to the foldable state from the support state, the first part and the second part are rotated relative to the first pivotable connection assembly so as to be parallel to the first supporter.

Further, the first pivotable connection assembly includes a first pivot element, a second pivot element, a first pivot shaft and a first fastener, the first pivot element includes a first connection portion and a first pivot portion connected to the first connection portion, the second pivot element includes a second connection portion and a second pivot portion connected to the second connection portion, the first connection portion is connected to the first part, the second connection portion is connected to the second part, the first pivot shaft includes a first cap and a first shaft connected to the first cap, the first shaft passes through a first pivot hole of the first pivot portion and a second pivot hole of the second pivot portion, and the first fastener is fixed at an end of the first shaft away from the first cap.

Further, the first pivot portion includes a first middle portion with the first pivot hole, a first connection plate surrounding the first middle portion, and a first extending plate connected to an edge of the first connection plate and toward to the second pivot portion, an end surface of the first extending plate forms a plurality of first tooth, the second pivot portion includes a second middle portion with the second pivot hole, a second connection plate surrounding the second middle portion, and a second extending plate connected to an edge of the second connection plate and toward to the first pivot portion, an end surface of the second extending plate forms a plurality of second tooth meshed with the first tooth.

Further, the first shaft includes external thread, and the first pivot portion, the second pivot portion and the first fastener includes inner thread.

Further, a side surface of the first cap includes a plurality of depression portion.

Further, the two first foldable supporters, the two first bottom rods and the first base element forms a first triangle structure in the support state.

Further, an external surface of the second pivot portion includes a first groove communicated with the second pivot hole, the first fastener is located at the first groove.

Further, the first connection portion includes a first accommodating groove, an end of the first part away from the first bottom rod is fixed in the first accommodating groove, and two first protrusions are located at two opposite sides of the end of the first part away from the first bottom rod to abut against an inner sidewall of the first accommodating groove; the second connection portion includes a second accommodating groove, an end of the second part away from the first supporter is fixed in the second accommodating groove, and two second protrusions are located at two opposite sides of the end of the second part away from the first supporter to abut against an inner sidewall of the second accommodating groove.

Further, the foldable exercise bar device further includes two second foldable supporters, each second foldable supporter includes a third part pivotablely connected to the second bottom rod, a fourth part pivotablely connected to the second supporter, and a second pivotable connection assembly pivotablely connected between the third part and the fourth part, when the foldable exercise bar device is in the support state, the third part and the fourth part are arranged along a line via the second pivotable connection assembly such that the second foldable supporter supports between the second supporter and the second bottom rod, when the foldable exercise bar device is changed to the foldable state from the support state, the third part and the fourth part are rotated relative to the pivotable connection assembly so as to be parallel to the second supporter.

Further, the second pivotable connection assembly includes a third pivot element, a fourth pivot element, a second pivot shaft and a second fastener, the third pivot element includes a third connection portion and a third pivot portion connected to the third connection portion, the fourth pivot element includes a fourth connection portion and a fourth pivot portion connected to the fourth connection portion, the third connection portion is connected to the third part, the fourth connection portion is connected to the fourth part, the second pivot shaft includes a second cap and a second shaft connected to the second cap, the second shaft passes through a third pivot hole of the third pivot portion and a fourth pivot hole of the fourth pivot portion, and the second fastener is fixed at an end of the second shaft away from the second cap.

Further, the third pivot portion includes a third middle portion with the third pivot hole, a third connection plate surrounding the third middle portion, and a third extending plate connected to an edge of the third connection plate and toward to the fourth pivot portion, an end surface of the third extending plate forms a plurality of third tooth, the fourth pivot portion includes a fourth middle portion with the fourth pivot hole, a fourth connection plate surrounding the fourth middle portion, and a fourth extending plate connected to an edge of the fourth connection plate and toward to the third connection portion, an end surface of the fourth extending plate forms a plurality of fourth tooth meshed the third tooth.

Further, each of the first supporter and the second supporter includes a first pipe and a second pipe retracted in the first pipe, the first pipe includes a first fixing hole, the second pipe includes a plurality of second fixing holes arranged along the second pipe, a third fastener passes through the first fixing hole and is fixed in different second fixing holes to adjust a support height of the first supporter and the second supporter.

The present disclosure has the beneficial effects: the foldable exercise bar device can be change between the support state and the foldable state, and in the foldable state, the two first bottom rods and the two second bottom rods are rotated to be parallel to the second supporter, such that the foldable exercise bar device can occupy a small space to improve user experience.

BRIEF DESCRIPTION OF THE DRAWINGS

Implementations of the present disclosure will now be described, by way of embodiment, with reference to the attached figures. It should be understood, the drawings are shown for illustrative purpose only, for ordinary person skilled in the art, other drawings obtained from these drawings without paying creative labor by an ordinary person skilled in the art should be within scope of the present disclosure.

DETAILED DESCRIPTION OF THE EMBODIMENTS

Figure 1:
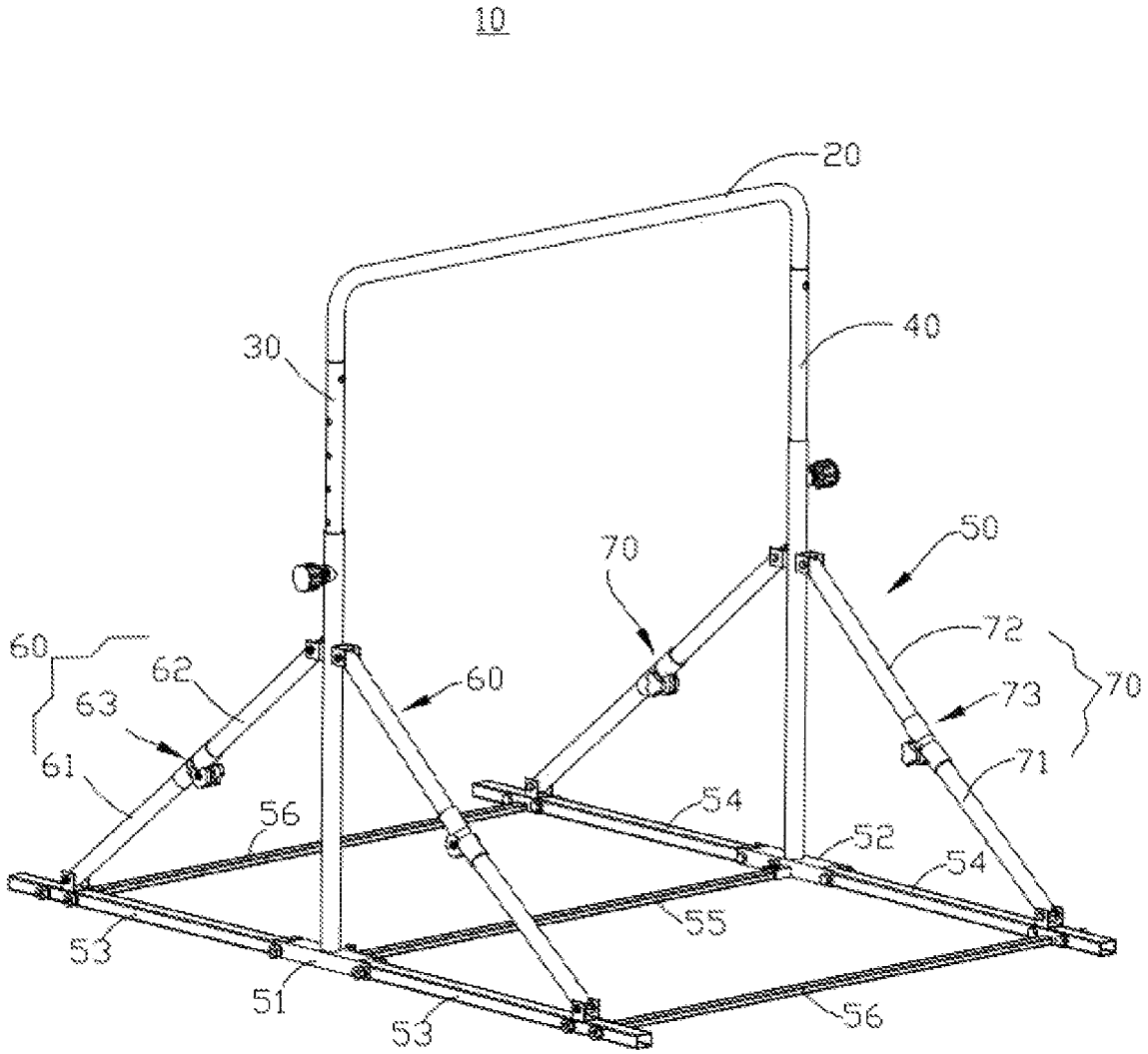
FIG. 1 is a schematic view of a foldable exercise bar device according to an embodiment of the present disclosure in a support state.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein may be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

The term "comprising" when utilized, means "including, but not necessarily limited to"; it specifically indicates open-ended inclusion or membership in the so-described combination, group, series, and the like. The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one". In addition, the terms "first" and "second" are used for descriptive purposes only and cannot be understood as indicating or implying relative importance or implying the number of indicated technical features. Thus, the features defined as "first" and "second" may explicitly or implicitly include one or more of the said features. In the description of embodiments of the application, "a plurality of" means two or more, unless otherwise specifically defined.

Figure 2:
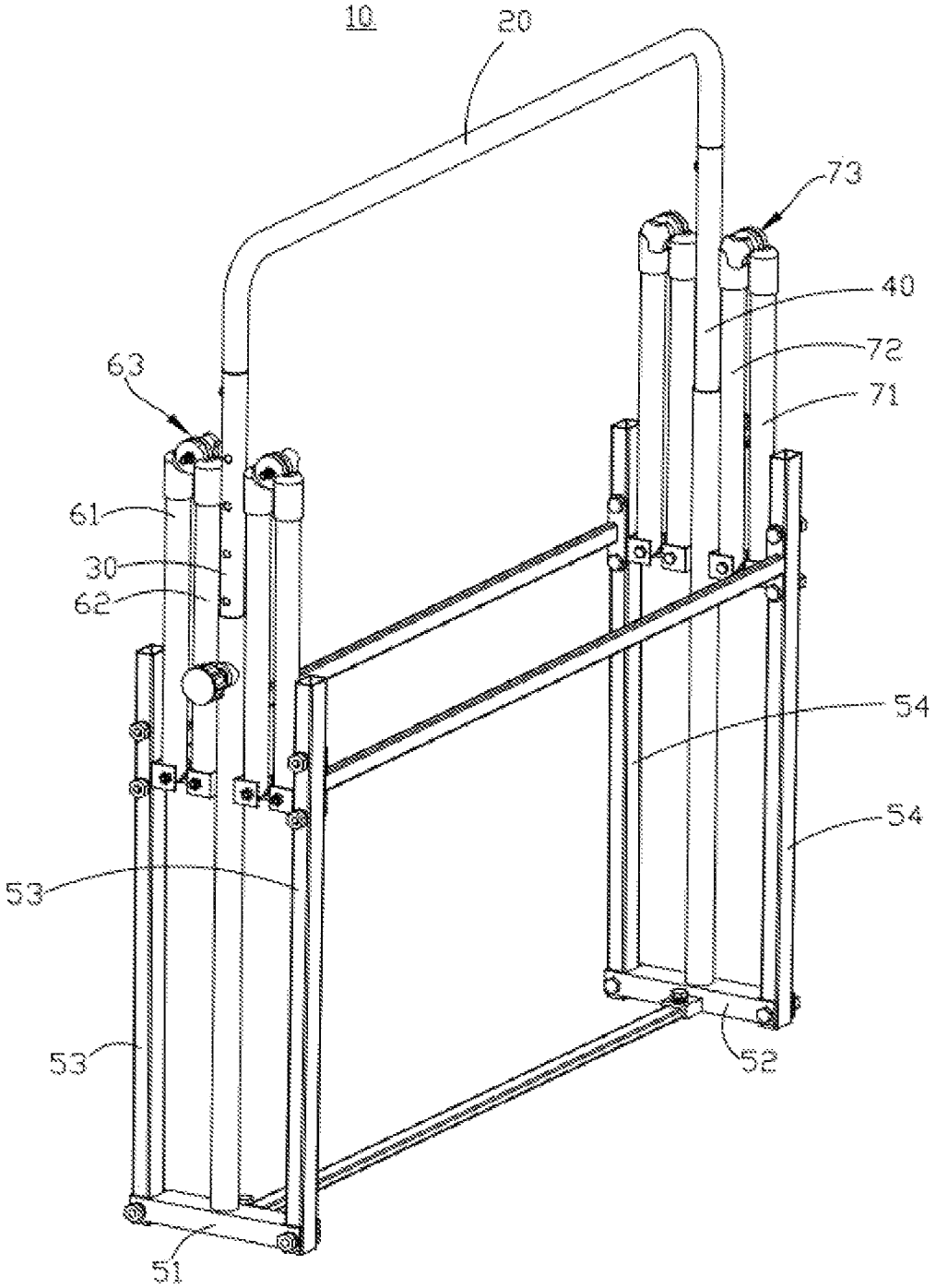
FIG. 2 is a schematic view of a foldable exercise bar device according to the embodiment of the present disclosure in a foldable state.
Figure 3:
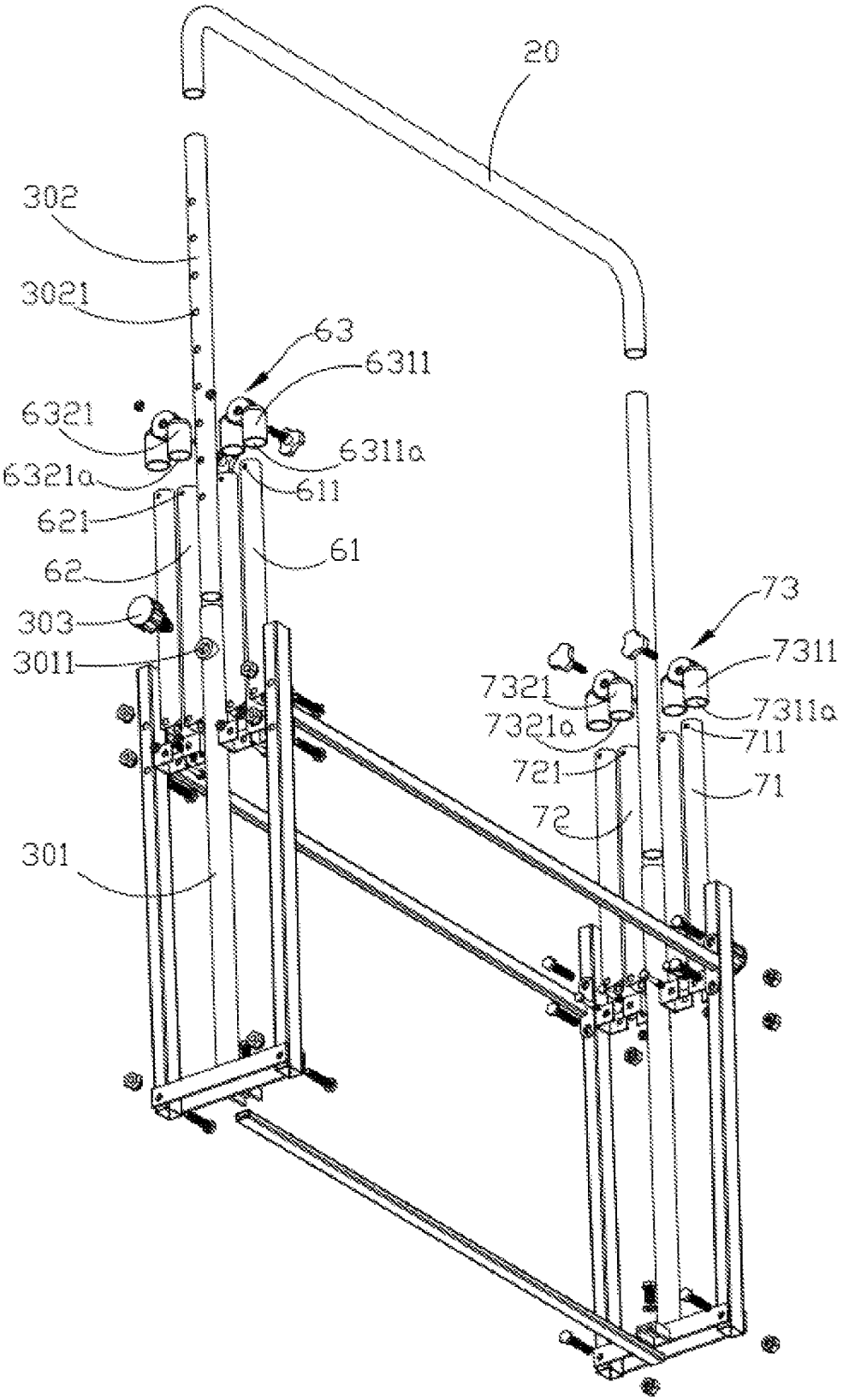
FIG. 3 is an exposed view of the foldable exercise bar device according to the embodiment of the present disclosure in the foldable state.

Referring to FIG. 1~FIG. 3, an embodiment of the present disclosure provides a foldable exercise bar device 10. A foldable exercise bar device 10 includes a bar 20; a first supporter 30 connected to an end of the bar 20; a second supporter 40 parallel to the first supporter 30 and connected to the other end of the bar 20; and a base module 50. The base module 50 includes a first base element 51 connected to an end of the first supporter 30 away from the bar 20, a second base element 52 facing with the first base element 51 and connected to an end of the second supporter 40 away from the bar, two first bottom rods 53 pivotablely connected to two opposite sides of the first base element 51, two second bottom rods 54 pivotablely connected to two opposite sides of the second base element 52.

When the foldable exercise bar device 10 is in a support state, the two first bottom rods 53 are arranged along a first line via the first base element 51 and perpendicular to the first supporter the two second bottom rods 54 are arranged along a second line via the second base element 52 and perpendicular to the second supporter 40.

When the foldable exercise bar device 10 is changed to a foldable state from the support state, the two first bottom rods 53 are rotated relative to the first base element 51 so as to be parallel to the first supporter 30, the two second bottom rods 54 are rotated relative to the second base element 52 so as to to be parallel to the second supporter 40.

The present disclosure has the beneficial effects: the foldable exercise bar device 10 can be change between the support state and the foldable state. In a support state, the two first bottom rods 53 are arranged along the first line via the first base element 51 to support the foldable exercise bar device 10, the two second bottom rods 54 are arranged along the second line via the second base element 52 to support the foldable exercise bar device 10. In the foldable state, the two first bottom rods 53 and the two second bottom rods 54 are rotated to be parallel to the second supporter such that the foldable exercise bar device 10 can occupy a small space to improve user experience.

In the embodiment, the base module 50 further includes a first connection rod 55 connected between the first base element 51 and the second base element 52 and two second connection rods 56 connected between the two first bottom rods 53 and two second bottom rods 54 respectively. The first connection rod 55 and the second connection rods are configured to support the foldable exercise bar device 10, and supporting stability of the foldable exercise bar device 10 is improved.

The second connection rod 56 is connected to an end of the corresponding one first bottom rod 53 away from the first base element 51 and an end of the corresponding one second bottom rod 54 away from the second base element 52.

The first connection rod 55 and the second connection rod 56 are parallel to each other and perpendicular to the two first bottom rods 53 and the two second bottom rods 54.

The foldable exercise bar device 10 further includes two first foldable supporters 60, each first foldable supporter 60 includes a first part 61 pivotablely connected to the first bottom rod 53, a second part 62 pivotablely connected to the first supporter 30, and a first pivotable connection assembly 63 pivotablely connected between the first part 61 and the second part 62.

When the foldable exercise bar device 10 is in the support state, the first part 61 and the second part 62 are arranged along a line via the first pivotable connection assembly 63 such that the first foldable supporter 60 supports between the first supporter 30 and the first bottom rod 53, when the foldable exercise bar device 10 is changed to the foldable state from the support state, the first part 61 and the second part 62 are rotated relative to the first pivotable connection assembly 63 so as to be parallel to the first supporter 30.

Figure 4:
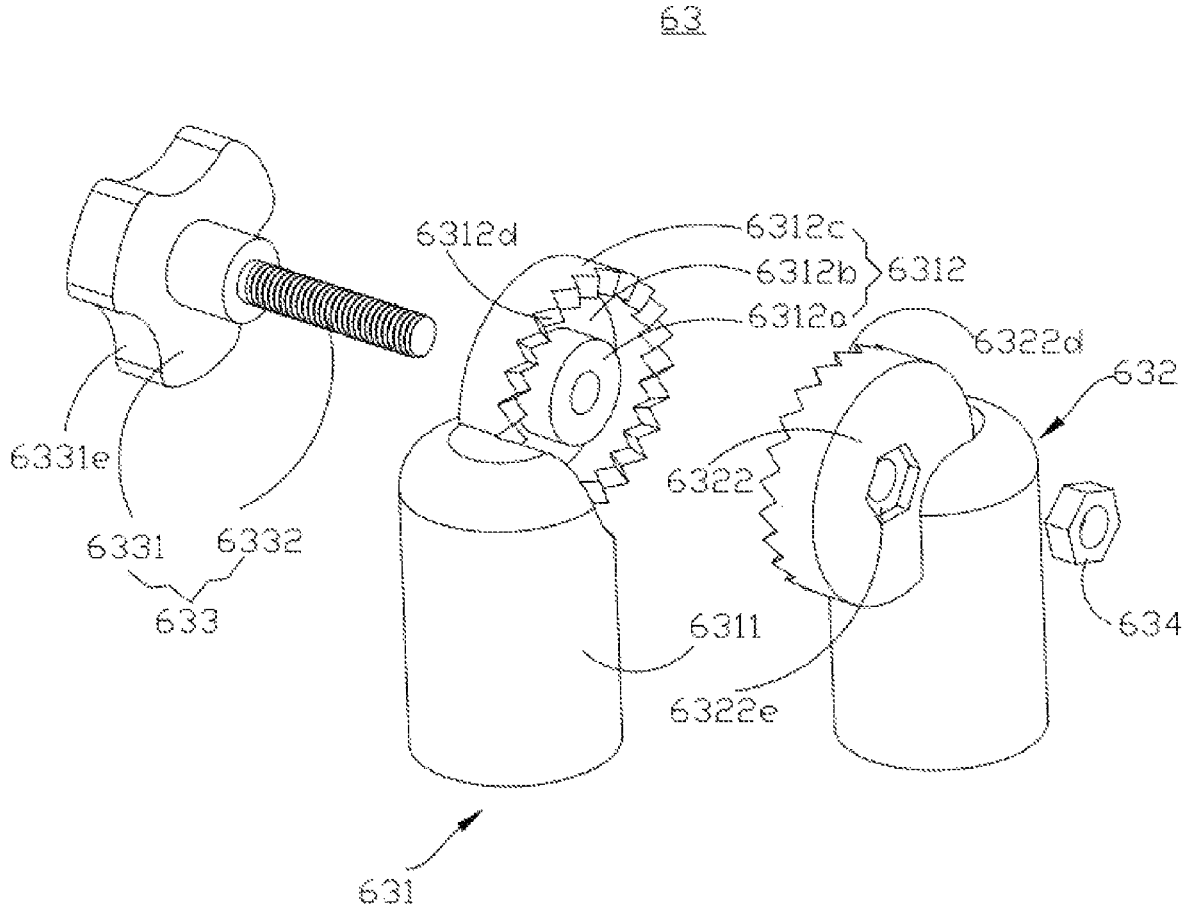
FIG. 4 is a schematic view of a first pivotable connection assembly of the foldable exercise bar device according to the embodiment of the present disclosure.
Figure 5:
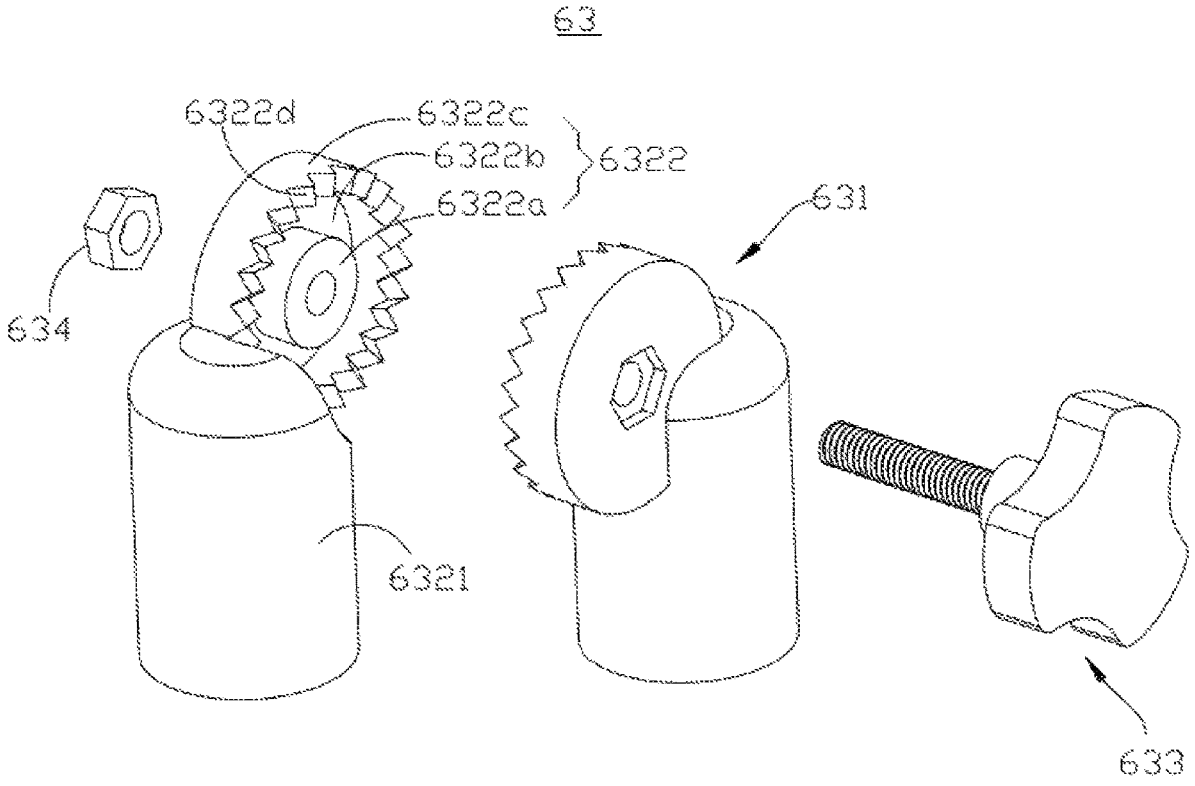
FIG. 5 is another schematic view of the first pivotable connection assembly of the foldable exercise bar device according to the embodiment of the present disclosure.

Referring to FIG. 4~FIG. 5, the first pivotable connection assembly 63 includes a first pivot element 631, a second pivot element 632, a first pivot shaft 633 and a first fastener 634. The first pivot element 631 includes a first connection portion 6311 and a first pivot portion 6312 connected to the first connection portion 6311. The second pivot element 632 includes a second connection portion 6321 and a second pivot portion 6322 connected to the second connection portion 6321, the first connection portion 6311 is connected to the first part 61, the second connection portion 6321 is connected to the second part 62. The first pivot shaft 633 includes a first cap 6331 and a first shaft 6332 connected to the first cap 6331, the first shaft 6332 passes through a first pivot hole of the first pivot portion 6312 and a second pivot hole of the second pivot portion 6322, and the first fastener 634 is fixed at an end of the first shaft 6332 away from the first cap 6331.

The first pivot portion 6312 includes a first middle portion 6312*a* with the first pivot hole, a first connection plate 6312*b* surrounding the first middle portion 6312*a*, and a first extending plate 6312*c* connected to an edge of the first connection plate 6312*b* and toward to the second pivot portion 6312. An end surface of the first extending plate 6312*c* forms a plurality of first tooth 6312*d*. The second pivot portion 6322 includes a second middle portion 6322*a* with the second pivot hole, a second connection plate 6322*b* surrounding the second middle portion 6322*a*, and a second extending plate 6322*c* connected to an edge of the second connection plate 6322*b* and toward to the first pivot portion 6312, an end surface of the second extending plate 6322*c* forms a plurality of second tooth 6322*d* meshed with the first tooth 6312*d*. When the foldable exercise bar device 10 is in the foldable state, the second tooth 6322*d* meshes with the first tooth 6312*d* to fix the foldable state of the first part 61 and the second part 62, security of the foldable exercise bar device 10 can be improved.

In the embodiment, the first shaft 6332 includes external thread, the first pivot portion 6312, the second pivot portion 6322 and the first fastener 634 includes inner thread corresponding to the external thread.

Further, a side surface of the first cap 6331 includes a plurality of first depression portions 6331*e* around the first cap 6331. Through the first depression portions 6331*e*, it is easy to rotate the first pivot shaft 633.

It can be seen that, the two first foldable supporters 60, the two first bottom rods 53 and the first base element 51 forms a first triangle structure in the support state. Through above structure, the supporting stability of the foldable exercise bar device 10 is further improved.

Furthermore, an external surface of the second pivot portion 6322 includes a first groove 6322*e* communicated with the second pivot hole, the first fastener 634 is located at the first groove 6322*e*.

The first connection portion 6311 includes a first accommodating groove 6311*a*, an end of the first part 61 away from the first bottom rod 53 is fixed in the first accommodating groove 6311*a*, and two first protrusions 611 are located at two opposite sides of the end of the first part 61 away from the first bottom rod 53 to abut against an inner sidewall of the first accommodating groove 6311*a*. The second connection portion 6321 includes a second accommodating groove 6321*a*, an end of the second part 62 away from the first supporter 30 is fixed in the second accommodating groove 6321*a*, and two second protrusions 621 are located at two opposite sides of the end of the second part 62 away from the first supporter 30 to abut against an inner sidewall of the second accommodating groove 6321*a*.

The foldable exercise bar device 10 further includes two second foldable supporters 70, each second foldable supporter 70 includes a third part 71 pivotablely connected to the second bottom rod 54, a fourth part 72 pivotablely connected to the second supporter 40, and a second pivotable connection assembly 73 pivotablely connected between the third part 71 and the fourth part 72.

When the foldable exercise bar device 10 is in the support state, the third part 71 and the fourth part 72 are arranged along a line via the second pivotable connection assembly 73 such that the second foldable supporter 70 supports between the second supporter 40 and the second bottom rod 54.

When the foldable exercise bar device 10 is changed to the foldable state from the support state, the third part 71 and the fourth part 72 are rotated relative to the pivotable connection assembly 73 so as to be parallel to the second supporter 40.

Figure 6:
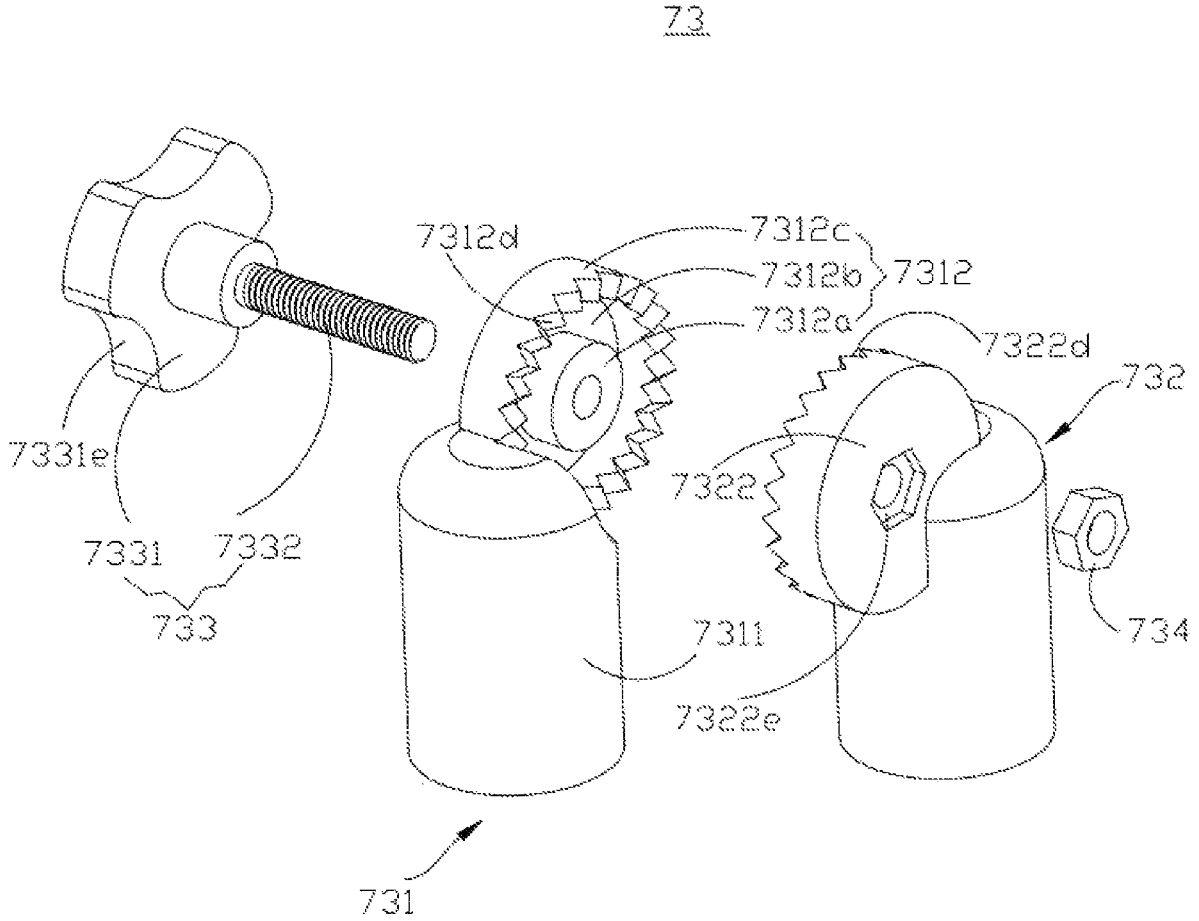
FIG. 6 is a schematic view of a second pivotable connection assembly of the foldable exercise bar device according to the embodiment of the present disclosure.
Figure 7:
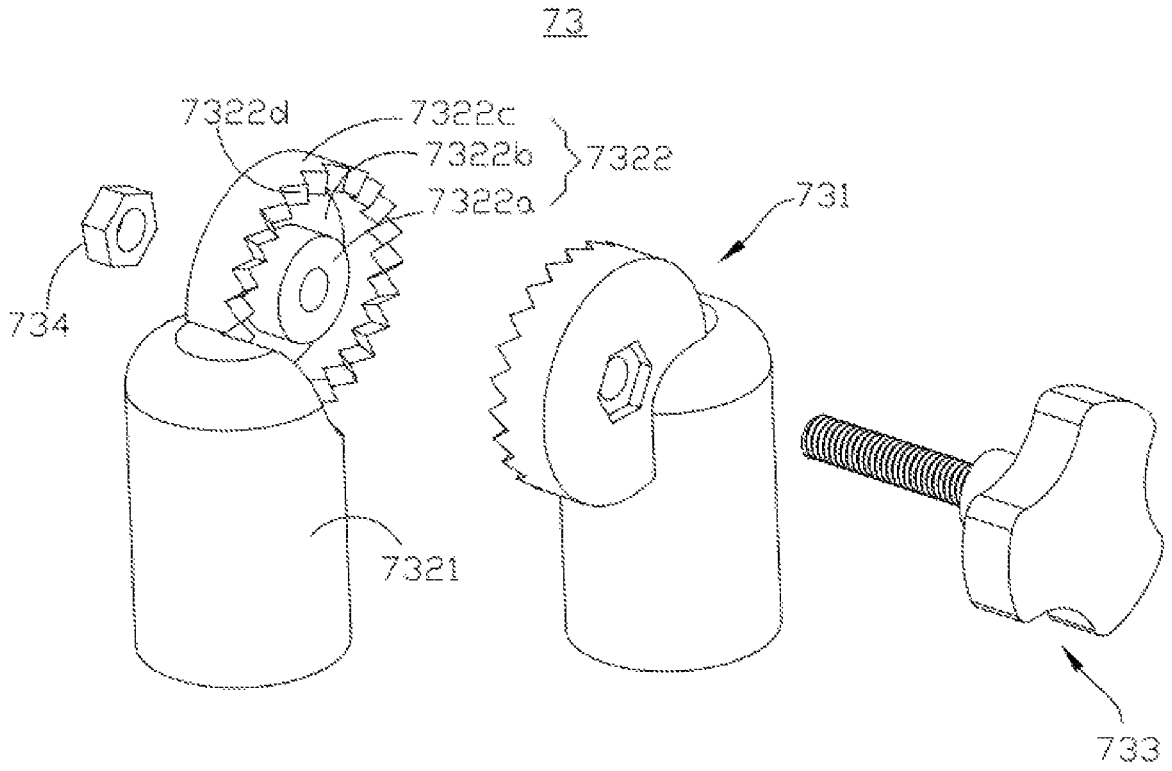
FIG. 7 is another schematic view of the second pivotable connection assembly of the foldable exercise bar device according to the embodiment of the present disclosure.

Referring to FIG. 6~FIG. 7, the second pivotable connection assembly 73 includes a third pivot element 731, a fourth pivot element 732, a second pivot shaft 733 and a second fastener 734. The third pivot element 731 includes a third connection portion 7311 and a third pivot portion 7312 connected to the third connection portion 7311. The fourth pivot element 732 includes a fourth connection portion 7321 and a fourth pivot portion 7322 connected to the fourth connection portion 7321. The third connection portion 7311 is connected to the third part 71, the fourth connection portion 7321 is connected to the fourth part 72. The second pivot shaft 733 includes a second cap 7331 and a second shaft 7332 connected to the second cap 7331. The second shaft 7332 passes through a third pivot hole of the third pivot portion 7312 and a fourth pivot hole of the fourth pivot portion 7322, and the second fastener 734 is fixed at an end of the second shaft 7332 away from the second cap 7331.

The third pivot portion 7312 includes a third middle portion 7312*a* with the third pivot hole, a third connection plate 7312*b* surrounding the third middle portion 7312*a*, and a third extending plate 7312*c* connected to an edge of the third connection plate 7312*b* and toward to the fourth pivot portion 7322. An end surface of the third extending plate 7312*c* forms a plurality of third tooth 7312*d*. The fourth pivot portion 7322 includes a fourth middle portion 7322*a* with the fourth pivot hole, a fourth connection plate 7322*b* surrounding the fourth middle portion 7322*a*, and a fourth extending plate 7322*c* connected to an edge of the fourth connection plate 7322*b* and toward to the third connection portion 7312*b*, an end surface of the fourth extending plate 7322*c* forms a plurality of fourth tooth 7322*d* meshed the third tooth 7312*d*.

In the embodiment, the second shaft 7332 includes external thread, the third pivot portion 7312, the fourth pivot portion 7322 and the second fastener 734 includes inner thread corresponding to the external thread.

Further, a side surface of the second cap 7331 includes a plurality of second depression portions 7331*e* around the second cap 7331. Through the second depression portions 7331*e*, it is easy to rotate the second pivot shaft 733.

It can be seen that, the two second foldable supporters 70, the two second bottom rods 54 and the second base element 52 forms a first triangle structure in the support state. Through above structure, the supporting stability of the foldable exercise bar device 10 is further improved.

Furthermore, an external surface of the fourth pivot portion 7322 includes a second groove 7322*e* communicated with the fourth pivot hole, the second fastener 734 is located at the second groove 7322*e*.

Referring to FIG. 3, the third connection portion 7311 includes a third accommodating groove 7311*a*, an end of the third part 71 away from the second bottom rod 73 is fixed in the third accommodating groove 7311*a*, and two third protrusions 711 are located at two opposite sides of the end of the third part 71 away from the second bottom rod 54 to abut against an inner sidewall of the third accommodating groove 7311*a*. The fourth connection portion 7321 includes a fourth accommodating groove 7321*a*, an end of the fourth part 72 away from the second supporter 40 is fixed in the fourth accommodating groove 7321*a*, and two fourth protrusions 721 are located at two opposite sides of the end of the fourth part 72 away from the second supporter 40 to abut against an inner sidewall of the fourth accommodating groove 7321*a*.

In the embodiment, the bar 20 can be a U-shaped structure. Each of the first supporter 30 and the second supporter 40 includes a first pipe 301 and a second pipe 302 retracted in the first pipe 301. The first pipe 301 includes a first fixing hole 3011, the second pipe 302 includes a plurality of second fixing holes 3021 arranged along the second pipe 302. A third fastener 303 passes through the first fixing hole 3011 and is fixed in different second fixing holes 302 to adjust a support height of the first supporter 301 and the second supporter 302.

One or more implementation modes are provided above in combination with specific contents, and it is not deemed that the specific implementation of the present disclosure is limited to these specifications. Any technical deductions or replacements approximate or similar to the method and structure of the present disclosure or made under the concept of the present disclosure shall fall within the scope of protection of the present disclosure.

What is claimed is:

1. A foldable exercise bar device, comprising:

a bar;

a first supporter connected to an end of the bar;

a second supporter parallel to the first supporter and connected to the other end of the bar; and a base module comprising a first base element connected to an end of the first supporter away from the bar, a second base element facing with the first base element and connected to an end of the second supporter away from the bar, two first bottom rods pivotablely connected to two opposite sides of the first base element, two second bottom rods pivotablely connected to two opposite sides of the second base element;

wherein when the foldable exercise bar device is in a support state, the two first bottom rods are arranged along a first line via the first base element and perpendicular to the first supporter, the two second bottom rods are arranged along a second line via the second base element and perpendicular to the second supporter, when the foldable exercise bar device is changed to a foldable state from the support state, the two first bottom rods are rotated relative to the first base element so as to be parallel to the first supporter, the two second bottom rods are rotated relative to the second base element so as to be parallel to the second supporter;

wherein the foldable exercise bar device further comprises two first foldable supporters, each first foldable supporter comprises a first part pivotablely connected to a respective first bottom rod, a second part pivotablely connected to the first supporter, and a first pivotable connection assembly pivotablely connected between the first part and the second part, when the foldable exercise bar device is in the support state, the first part and the second part are arranged along a line via the first pivotable connection assembly such that the first foldable supporter supports between the first supporter and the first bottom rod, when the foldable exercise bar device is changed to the foldable state from the support state, the first part and the second part are rotated relative to the first pivotable connection assembly so as to be parallel to the first supporter.

2. The foldable exercise bar device according to claim 1, wherein the base module further comprises a first connection rod connected between the first base element and the second base element and two second connection rods connected between the two first bottom rods and two second bottom rods respectively.

3. The foldable exercise bar device according to claim 2, wherein the second connection rod is connected to an end of the corresponding one first bottom rod away from the first base element and an end of the corresponding one second bottom rod away from the second base element.

4. The foldable exercise bar device according to claim 2, wherein the first connection rod and the second connection rod are parallel to each other and perpendicular to the two first bottom rods and the two second bottom rods.

5. The foldable exercise bar device according to claim 1, wherein the first pivotable connection assembly comprises a first pivot element, a second pivot element, a first pivot shaft and a first fastener, the first pivot element comprises a first connection portion and a first pivot portion connected to the first connection portion, the second pivot element comprises a second connection portion and a second pivot portion connected to the second connection portion, the first connection portion is connected to the first part, the second connection portion is connected to the second part, the first pivot shaft comprises a first cap and a first shaft connected to the first cap, the first shaft passes through a first pivot hole of the first pivot portion and a second pivot hole of the second pivot portion, and the first fastener is fixed at an end of the first shaft away from the first cap.

6. The foldable exercise bar device according to claim 5, wherein the first pivot portion comprises a first middle portion with the first pivot hole, a first connection plate surrounding the first middle portion, and a first extending plate connected to an edge of the first connection plate and toward to the second pivot portion, an end surface of the first extending plate forms a plurality of first tooth, the second pivot portion comprises a second middle portion with the second pivot hole, a second connection plate surrounding the second middle portion, and a second extending plate connected to an edge of the second connection plate and toward to the first pivot portion, an end surface of the second extending plate forms a plurality of second tooth meshed with the first tooth.

7. The foldable exercise bar device according to claim 5, wherein the first shaft comprises external thread, and the first pivot portion, the second pivot portion and the first fastener comprises inner thread.

8. The foldable exercise bar device according to claim 5, wherein a side surface of the first cap comprises a plurality of depression portion.

9. The foldable exercise bar device according to claim 5, wherein the two first foldable supporters, the two first bottom rods and the first base element forms a first triangle structure in the support state.

10. The foldable exercise bar device according to claim 5, wherein an external surface of the second pivot portion comprises a first groove communicated with the second pivot hole, the first fastener is located at the first groove.

11. The foldable exercise bar device according to claim 5, wherein the first connection portion comprises a first accommodating groove, an end of the first part away from the first bottom rod is fixed in the first accommodating groove, and two first protrusions are located at two opposite sides of the end of the first part away from the first bottom rod to abut against an inner sidewall of the first accommodating groove; the second connection portion comprises a second accommodating groove, an end of the second part away from the first supporter is fixed in the second accommodating groove, and two second protrusions are located at two opposite sides of the end of the second part away from the first supporter to abut against an inner sidewall of the second accommodating groove.

12. The foldable exercise bar device according to claim 1, wherein the foldable exercise bar device further comprises two second foldable supporters, each second foldable supporter comprises a third part pivotablely connected to a respective second bottom rod, a fourth part pivotablely connected to the second supporter, and a second pivotable connection assembly pivotablely connected between the third part and the fourth part, when the foldable exercise bar device is in the support state, the third part and the fourth part are arranged along a line via the second pivotable connection assembly such that the second foldable supporter supports between the second supporter and the second bottom rod, when the foldable exercise bar device is changed to the foldable state from the support state, the third part and the fourth part are rotated relative to the pivotable connection assembly so as to be parallel to the second supporter.

13. The foldable exercise bar device according to claim 12, wherein the second pivotable connection assembly comprises a third pivot element, a fourth pivot element, a second pivot shaft and a second fastener, the third pivot element comprises a third connection portion and a third pivot portion connected to the third connection portion, the fourth pivot element comprises a fourth connection portion and a fourth pivot portion connected to the fourth connection portion, the third connection portion is connected to the third part, the fourth connection portion is connected to the fourth part, the second pivot shaft comprises a second cap and a second shaft connected to the second cap, the second shaft passes through a third pivot hole of the third pivot portion and a fourth pivot hole of the fourth pivot portion, and the second fastener is fixed at an end of the second shaft away from the second cap.

14. The foldable exercise bar device according to claim 13, wherein the third pivot portion comprises a third middle portion with the third pivot hole, a third connection plate surrounding the third middle portion, and a third extending plate connected to an edge of the third connection plate and toward to the fourth pivot portion, an end surface of the third extending plate forms a plurality of third tooth, the fourth pivot portion comprises a fourth middle portion with the fourth pivot hole, a fourth connection plate surrounding the fourth middle portion, and a fourth extending plate connected to an edge of the fourth connection plate and toward to the third connection portion, an end surface of the fourth extending plate forms a plurality of fourth tooth meshed the third tooth.

15. The foldable exercise bar device according to claim 1, wherein each of the first supporter and the second supporter comprises a first pipe and a second pipe retracted in the first pipe, the first pipe comprises a first fixing hole, the second pipe comprises a plurality of second fixing holes arranged along the second pipe, a third fastener passes through the first fixing hole and is fixed in different second fixing holes to adjust a support height of the first supporter and the second supporter.

* * * * *